US007296721B1

(12) United States Patent
Wen

(10) Patent No.: US 7,296,721 B1
(45) Date of Patent: Nov. 20, 2007

(54) PNEUMATIC NAIL GUN HAVING NAIL PUSHER

(75) Inventor: Wan-Fu Wen, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 0 days.

(21) Appl. No.: 11/465,610

(22) Filed: Aug. 18, 2006

(51) Int. Cl.
*B25C 1/04* (2006.01)

(52) U.S. Cl. ..... 227/130; 227/8

(58) Field of Classification Search ..... 227/130, 227/8

See application file for complete search history.

(56) References Cited

U.S. PATENT DOCUMENTS 3,099,837 A * 8/1963 Heilman et al. ..... 227/136
3,622,062 A * 11/1971 Goode et al. ..... 227/130
3,858,780 A * 1/1975 Perkins et al. ..... 227/8
4,313,552 A * 2/1982 Maurer ..... 227/109
4,319,705 A * 3/1982 Geist et al. ..... 227/120
4,736,879 A * 4/1988 Yamada et al. ..... 227/130
4,784,308 A * 11/1988 Novak et al. ..... 227/130
4,909,419 A * 3/1990 Yamada et al. ..... 227/1
5,135,152 A * 8/1992 Uno et al. ..... 227/116
6,006,975 A * 12/1999 Ishizawa ..... 227/119
7,225,962 B2 * 6/2007 Porth et al. ..... 227/136

* cited by examiner

*Primary Examiner*—Rinaldi I. Rada
*Assistant Examiner*—Michelle Lopez

(57) ABSTRACT

An exemplary pneumatic nail gun includes a gun body having a nail punching piston and a nail pushing passage. A nail pusher has a nail pushing cylinder connecting to the nail pushing passage. The nail pushing cylinder includes a nail pushing piston and a spring. An air distribution ring having an axial through hole and a radial through hole. The axial through hole guides the high pressure air to drive the nail punching piston to reposition after the nail punching piston downwardly moving to punch the nails. The radial through hole guides the high pressure air into the nail pushing cylinder via the nail pushing passage to drive the nail pushing piston to take the nails, and also exhaust the high pressure air in the nail pushing cylinder and the nail pushing passage to make the nail pushing piston reposition to push the nails when the nail punching piston reposition.

7 Claims, 6 Drawing Sheets

PNEUMATIC NAIL GUN HAVING NAIL PUSHER

BACKGROUND

The present invention relates to a nail gun with a nail pusher, and particularly to a pneumatic nail gun having an air distribution ring being used for guiding high pressure air to drive or release a nail pushing position of a nail pusher.

Pneumatic nail gun generally utilizes a compressed high pressure air to drive a piston to punch a nail, for joining two objects by shooting a nail through both objects. A typical pneumatic nail gun includes a gun body having a cylinder and a nail punching piston dividing the cylinder into a top air chamber and a bottom air chamber. When a trigger of the gun body is triggered, high pressure air is introduced into the top air chamber for driving the nail punching piston to move downward, to punch the nail. In a reverse case, when the trigger is released, the high pressure air in the top air chamber is exhausted, and other high pressure air is introduced into the bottom air chamber to reposition the nail punching piston.

A conventional pneumatic nail gun is generally classified into two types, one kind being coupled with a magazine and another kind being coupled with a canister. The typical structure and function of a nail gun with a canister is briefly described as follows. This kind of nail gun has a nail pusher arranged at a side of the gun body thereof. The nail pusher includes a cylinder, a nail pushing piston disposed in the cylinder, and a spring abutting the nail pushing piston. Moreover, the gun body includes a nail pushing passage and an air collection chamber, and the nail pushing passage is connected between the air collection chamber of the gun body and the cylinder of the nail pusher. The air collection chamber is used for collecting the high pressure air that is introduced in from the top air chamber when the nail punching piston moves downward, so as to guide the high pressure air into the cylinder of the nail pusher via the nail pushing passage for driving the nail pushing piston. When the nail punching piston is driven to the original position, the high pressure air in the air collection chamber, the nail pushing passage, and the cylinder of the nail pusher are exhausted, to make the nail pushing piston reposition via pushing by the abutting spring.

However, the air collection chamber can just receive limited high pressure air when the nail punching piston moves downward. Therefore, the limited high pressure air in the air collection chamber is not sufficient to drive the nail pushing piston to take the next nail for being driven and drive the nail punching piston to the original position, particularly in the process of continuously punching and pushing the nails. That is, the stability of the movement of the nail pushing piston is low, and the instability upward movement of the nail punching piston lowers the speed and efficiency of punching the nail.

Accordingly, what is needed is a pneumatic nail gun that can overcome the above-described deficiencies.

BRIEF SUMMARY

A pneumatic nail gun includes a gun body which includes a nail punching piston and a nail pushing passage. The nail punching piston is induced by high pressure air to move downwardly to punch the nails and move upwardly to reposition. A nail pusher is disposed between an end of the nail pushing passage and a canister. The nail pusher includes a nail pushing cylinder connecting to the nail pushing passage. The nail pushing cylinder includes a nail pushing piston and a spring therein. An air distribution ring fixing to an inner surface of the gun body and adjacent to the other end of the nail pushing passage. The air distribution ring includes at least one axial through hole and at least one radial through hole. The axial through hole guides the high pressure air to drive the nail punching piston to reposition after the nail punching piston moving downwardly to punch the nails. The radial through hole guides and pushes the high pressure air into the nail pushing cylinder via the nail pushing passage to drive the nail pushing piston to take the nails after the nail punching piston move downwardly to punch the nails. The radial through hole also exhausts the high pressure air in the nail pushing cylinder and the nail pushing passage to make the nail pushing piston reposition to push the nails when the nail punching piston move upwardly to reposition.

In an alternative modification, the pneumatic nail gun further includes an exhausting hole connecting with environment that is disposed at an inner surface of the nail pushing cylinder or the nail pushing piston, which can enhance the speed of reposition of the nail pushing piston after the next nail was taken. Moreover, the exhausting hole has a cross section farther smaller than the cross section of the nail pushing passage, which can help to maintain the air pressure of the high pressure air in the nail pushing cylinder and prevent the high pressure air from exhausting from the nail pushing cylinder too fast.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
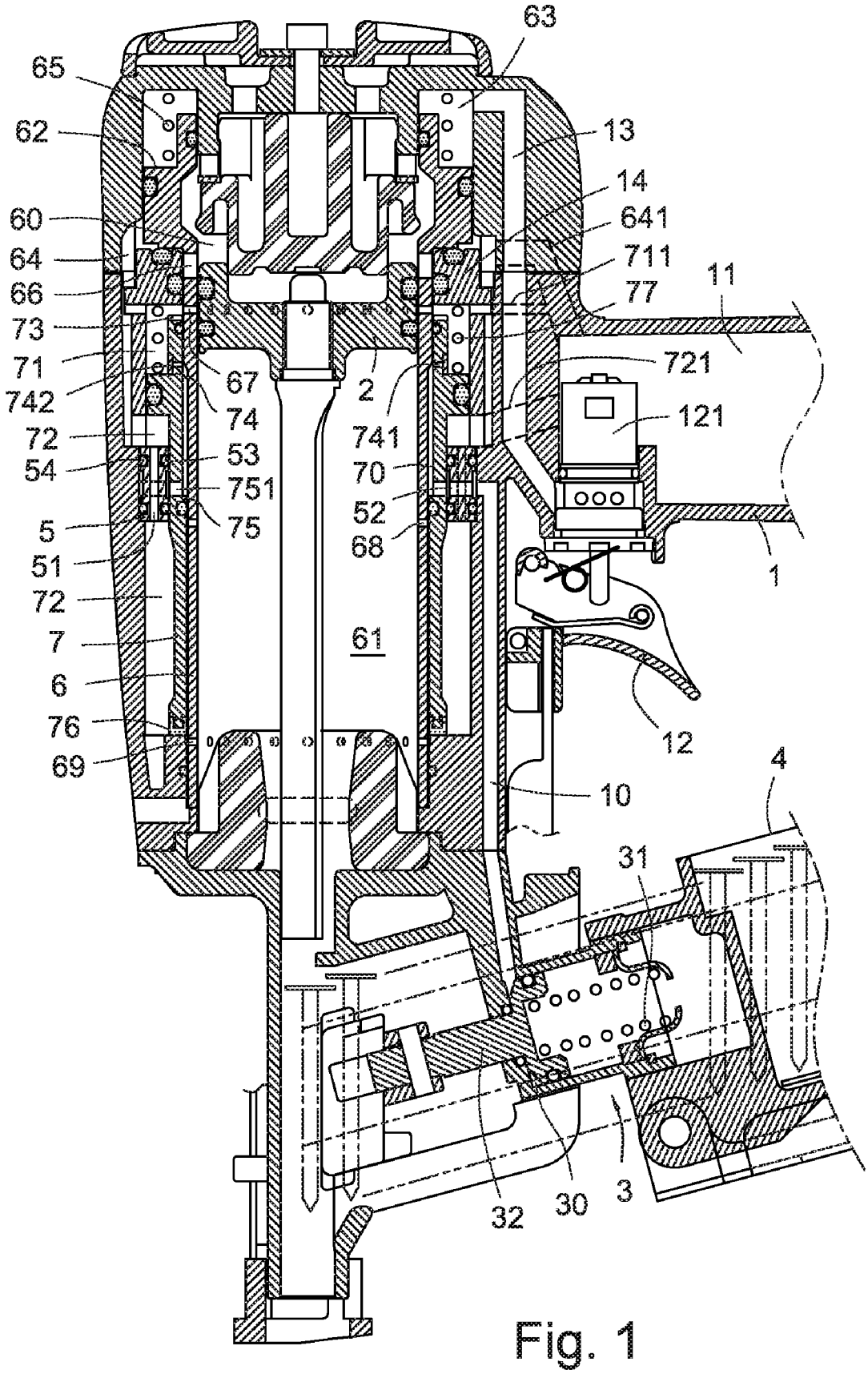
FIG. 1 is a cross-sectional view of a pneumatic nail gun according to an exemplary embodiment of the present invention, the pneumatic nail gun having a nail pusher and an air distribution ring arranged in a gun body of the pneumatic nail gun.
Figure 2:
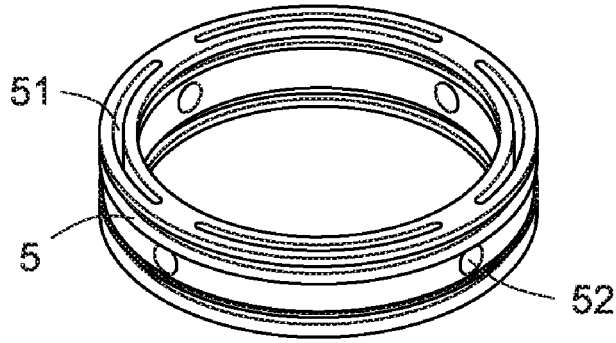
FIG. 2 is an enlarged, perspective view of the air distribution ring of FIG. 1, the air distribution ring having radial through holes and axial through holes thereof.

Referring to FIG. 1, an exemplary pneumatic nail gun according to the present invention is shown. The pneumatic nail gun includes a gun body 1, a nail pusher 3, and an air distribution ring 5 (shown in FIG. 2).

The gun body 1 includes a nail punching piston 2 and a nail pushing passage 10. The nail punching piston 2 is induced by high pressure air to move downwardly to punch the nails and move upwardly to reposition.

The nail pusher 3 is disposed between an end of the nail pushing passage 10 and a canister 4. The nail pusher 3 includes a nail pushing cylinder 30 (shown in FIG. 6) connecting to the nail pushing passage 10, and the nail pushing cylinder 30 includes a nail pushing piston 32 and a spring 31 therein.

Figure 3:
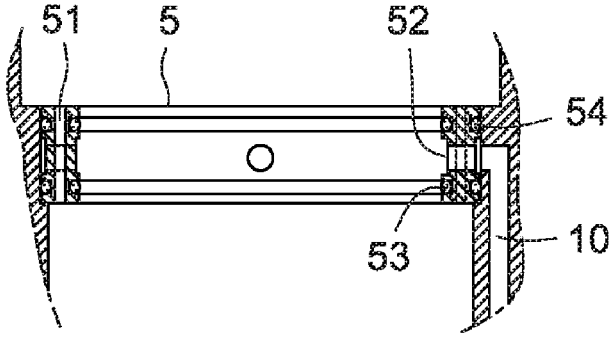
FIG. 3 is an enlarged, cross-sectional view of the air distribution ring of FIG. 2, showing the air distribution ring nesting on an inner surface of a gun body of the pneumatic nail gun of FIG. 1.
Figure 4:
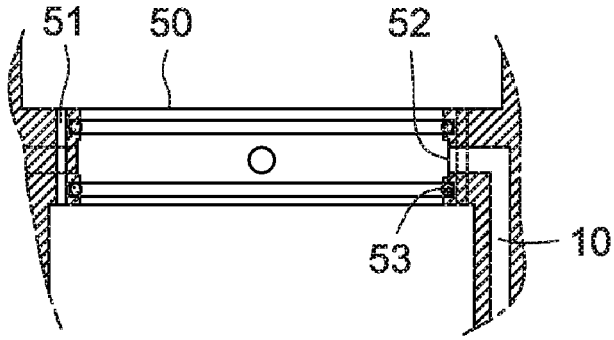
FIG. 4 is an enlarged, cross-sectional view of another air distribution ring integrally formed with an inner surface of a gun body of the pneumatic nail gun of FIG. 1.

The air distribution ring 5 includes at least one axial through hole 51 and at least one radial through hole 52. The air distribution ring 5 is fixed to an inner surface of the gun body 1 via nesting (shown in FIG. 3) or integrally formed with (shown in FIG. 4) the inner surface thereof. When the air distribution ring 5 is nested at the inner surface of the gun body 1, a plurality of air seals 53 and 54 (shown in FIG. 3) are employed. The air seals 53 are used for forming air seal with the outer surface of other elements in the gun body, and the air seals 54 are used for forming air seal between the radial through hole 52 and the nail pushing passage 10. On the other hand, the air seals 54 may be omitted when the air distribution ring 5 is integrally formed with the inner surface of the gun body 1.

Figure 5:
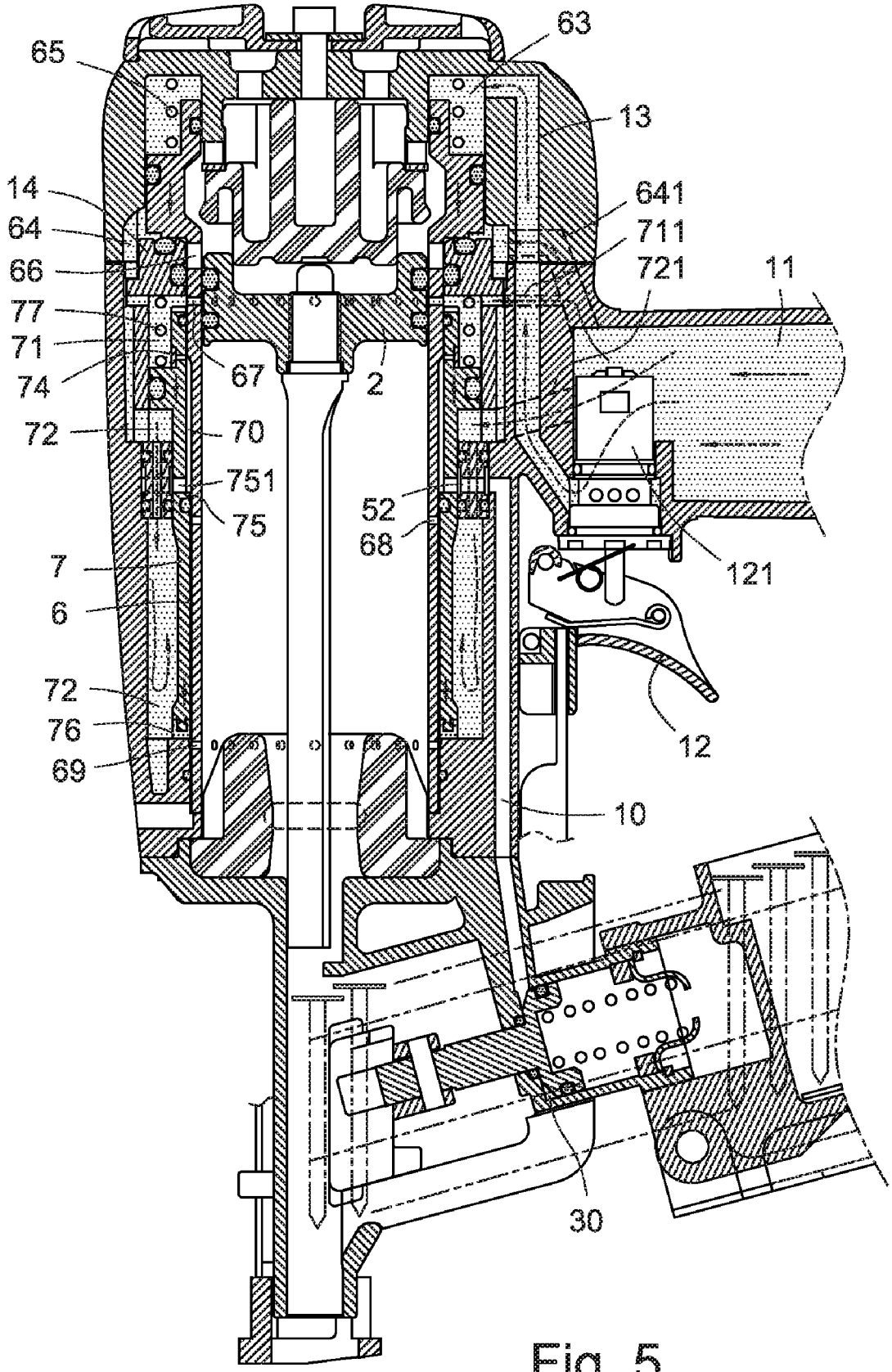
FIG. 5 is a cross-sectional view of the pneumatic nail gun of FIG. 1, showing a state of the passage of the high pressure air therein when a trigger is not triggered.

The gun body 1 forms a main air chamber 11 therein for collecting high pressure air guiding from air supplier and maintaining air pressure thereof (shown in FIGS. 1 and 5). The main air chamber 11 includes a trigger 12 for triggering by the user, a trigger valve 121 is inserted into the main air chamber 11, and the gun body 1 includes a trigger passage 13. The trigger valve 121 may control the main air chamber 11 connection with the trigger passage 13 or not.

The gun body 1 may employ a movable cylinder 6 and a slidable sleeve valve 7. In which, the movable cylinder 6 includes the nail punching piston 2, which may divide the cylinder 6 into a top air chamber 60 and a bottom air chamber 61 (shown in FIG. 6). The cylinder 6 further includes a head valve 62 adjacent to top of the normal valve 14 to divides the cylinder 6 into a first air chamber 63 and a second air chamber 64 connecting to the main air chamber 11. The first air chamber 63 includes a spring 65 therein, and the first air chamber 63 is connected to the main air chamber 11 via the trigger passage 13 and the trigger valve 121. The second air chamber 64 includes a second passage 641 formed around peripheral of the second air chamber 64, and connects to the main air chamber 11. The cylinder 6 includes a plurality of main vent holes 66, top vent holes 67, intermediate vent holes 68, and bottom vent holes 69 connecting the top and bottom air chambers 60 and 61.

The slidable sleeve valve 7 is disposed at peripheral position of the cylinder 6 (shown in FIG. 1), and a ring groove 70 is formed therebetween. The slidable sleeve valve 7 includes a plurality of top groove 73, a check valve 74, an intermediate valve 75, and a bottom valve 76 disposed an inner surface thereof. The slidable sleeve valve 7 divides the gun body 1 into a third air chamber 71 and a fourth air chamber 72 for containing high pressure air. The third air chamber 71 includes a third passage 711 connecting to the main air chamber 11, and the third air chamber 71 is connected to the top vent holes 67 of the cylinder 6 via the top groove 73. The third air chamber 71 includes a bottom spring 77. The check valve 74 is cooperatively formed by the plurality of through holes 741 of the side surface of the slidable sleeve valve 7 and an O-ring (or elastomer band) 742. The check valve 74 is used for single directly guiding the high pressure air in the ring groove 70 into the third air chamber (shown in FIG. 7). The vent holes 751 of intermediate valve 75 may make the top air chamber 60 and the nail pushing passage 10 to be connected via the intermediate vent holes 68 when the cylinder 6 upwardly moves and the nail punching piston 2 moves downwardly (shown in FIG. 6). The bottom valve 76 is closed when the slide sleeve valve 7 moves downwardly and is opened when the slide sleeve valve 7 upwardly moves (shown in FIG. 7). When the bottom valve 76 is opened, the bottom vent holes 69 may make the fourth air chamber 72 connect with the bottom air chamber 61. The fourth air chamber 72 includes fourth passage 721 disposed at peripheral portion thereof, which is connected to the main air chamber 11. All the elements mentioned above are employed with air seals for maintaining the function of air seal.

The air distribution ring 5 may be disposed at an inner surface of the gun body 1 in the fourth air chamber 72, to divides the fourth air chamber 72 into two regions that connecting via the axial through hole 51 so as to avoid impacting the air collection of the fourth air chamber 72. The radial through hole 52 may make the intermediate valve 75, the ring groove 70, the nail pushing passage 10, and the nail pushing cylinder 30 connect together.

In operation, before the trigger 12 is manipulated as shown in FIG. 5, high pressure air in the main air chamber 11 is applied to the first air chamber 63 through the trigger passage 13 and trigger valve 121, and to the second, third, and fourth air chambers 64, 71, 72 through the second passage 641, the third passage 711, and the fourth passage 721, respectively. The axial through hole 51 may make the top region and the bottom region of the fourth air chamber 72 connect with each other. The high pressure air in the third air chamber 71 and the bottom spring 77 cooperatively drive the slidable sleeve valve 7 move downwardly to certain position. Meanwhile, the main vent holes 66, the top vent holes 67, the intermediate vent holes 68, and the bottom vent holes 69 is closed by the normal valve 14, the nail punching piston 2, the intermediated valve 75, and the bottom valve 76, respectively, so as to prevent the high pressure air in the first, second, third and fourth air chamber 63, 64, 71 and 72 entering into the cylinder 6. The check valve 74 prevents the high pressure air in the third air chamber 71 from entering into the nail pushing passage 10 and the nail pushing cylinder 30 via the ring groove 70, the vent holes 751 of the intermediate valve 75 and the radial through holes 52.

Figure 6:
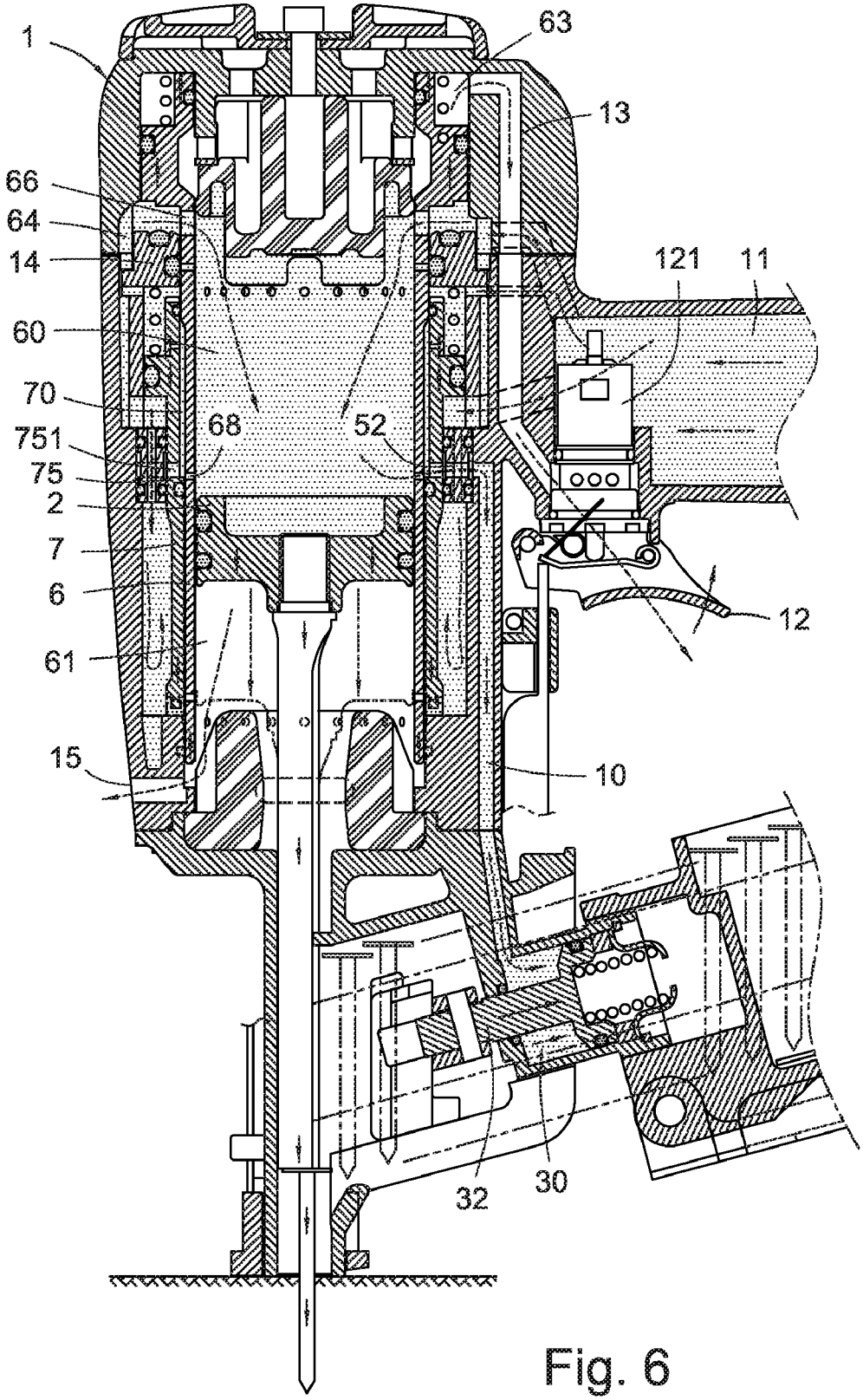
FIG. 6 is another cross-sectional view of the pneumatic nail gun of FIG. 1, showing a state of the passage of the high pressure air therein when the trigger is triggered.

When the trigger 12 is pulled as shown in FIG. 6, the trigger valve 121 closes the fluid communication between the main air chamber 11 and the trigger passage 13. High pressure air in the first air chamber 63 is discharged to the atmosphere, so that high pressure air in the second air chamber 64 drives the cylinder 6 to upwardly move to its upper dead center. The normal valve 14 opens the fluid communication from the second air chambers 64 to the main vent holes 66, and introduces high pressure air into the cylinder 6, applied to the nail punching piston 2. Thus, the piston 2 rapidly moves toward the nails. In addition, the bottom exhausting hole 15 is opened for discharging compressed high pressure air under the piston 2 to an atmosphere.

When the nail punching piston 2 move downwardly a certain distance to make the top air chamber 60 connect with the intermediate vent holes 68, the high pressure air in the top air chamber 60 may continuously being guided into the nail pushing cylinder 30 via intermediate vent holes 68, the vent holes 751 of the intermediate valve 75, the radial through holes 52, and the nail pushing passage 10, to drive the nail pushing piston to take the nails.

Figure 7:
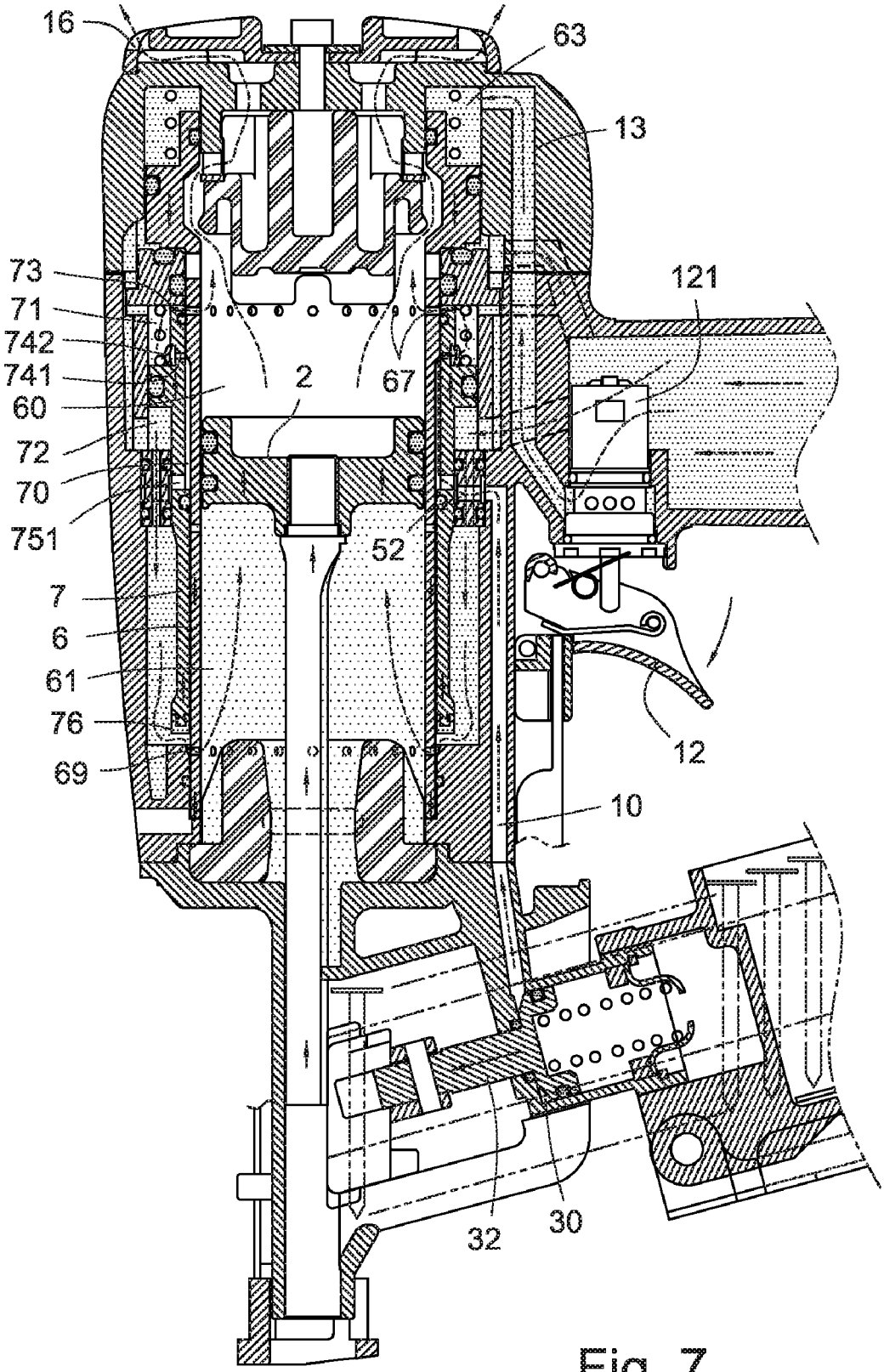
FIG. 7 is further another cross-sectional view of the pneumatic nail gun of FIG. 1, showing a state of the passage of the high pressure air therein when a trigger is released.

Then, when the user releases the trigger 12 as shown in FIG. 7, the trigger valve 121 returns to the original open state so that the first air chamber 63 re-accumulates high-pressure air. Before the piston 2 move upwardly to close the top vent holes 67, the high pressure air in the third air chamber 71 may exhaust to the top air chamber 60 via the top vent holes 67, to make the slidable sleeve valve 7 upwardly move induced by the high pressure air in the fourth air chamber 72 for opening the bottom valve 76. Then the high pressure air in the fourth air chamber 72 are guided into the bottom air chamber 61 via the bottom vent holes 69 to enhance the speed of upwardly moving of the piston 2. Meanwhile, the residual high pressure air in the top air chamber 60 may be exhausted via top exhausting holes 16 in a top portion of the gun body 1 to make the top air chamber 60 in a state of lower pressure. The high pressure air in the nail pushing cylinder 30 may discharge to atmosphere via the passage 10, the radial through hole 52, the intermediate valve 75, the ring groove 70, the through holes 741, the O-ring (or elastomer band) 742, the top groove 73, and the top air chamber 60, to drive the nail pushing piston 32 to push nails.

When the nail punching piston 2 is repositioned as shown in FIG. 5, the main vent holes 66, the top vent holes 67, the intermediate vent holes 68, and the bottom vent holes 69 is re-closed to make the air compressed in the first, second, third and fourth air chamber 63, 64, 71 and 72, and to make the slidable sleeve valve 7 move downwardly for making the trigger 12 in an original state.

Therefore, from above description, it is known that in the above embodiment of the present invention, the axial and radial through holes 51 and 52 of the air distribution ring 5 may help to maintain the air pressure and enhance the speed of pushing the nails. The radial through holes 52 may help to exhaust the compressed air in the cylinder 30 rapidly, so as to improve the speed, stability, and efficiency of punching the nail.

Figure 8:
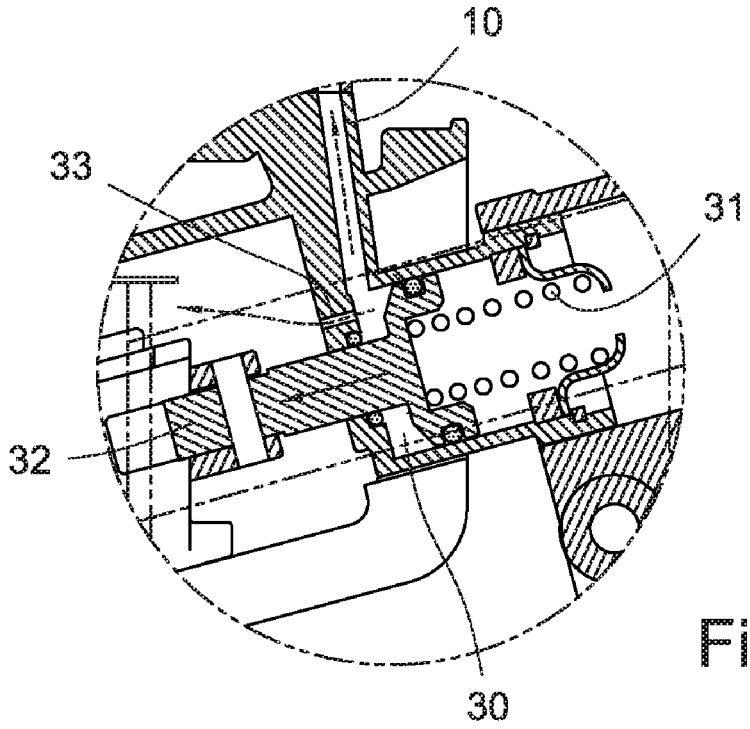
FIG. 8 is an enlarged, cross-sectional view of part of a cylinder of a nail pusher of a pneumatic nail gun according to another embodiment of the present invention, showing an exhausting hole connecting with environment, which is disposed at an inner surface of the cylinder.
Figure 9:
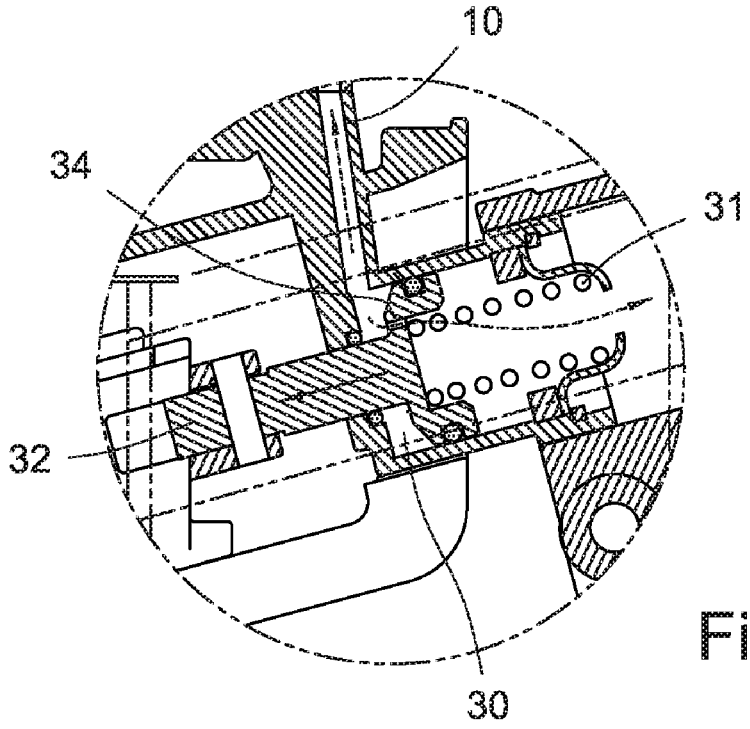
FIG. 9 is an enlarged, cross-sectional view of part of a cylinder of a nail pusher of a pneumatic nail gun according to further another embodiment of the present invention, showing an exhausting hole connecting with environment, which is disposed at a nail pushing piston of nail pusher.

In an alternative modification, the pneumatic nail gun further includes an exhausting hole 33 or 34 (shown in FIGS. 8 and 9) connecting with environment that is disposed at an inner surface of the nail pushing cylinder 30 or the nail pushing piston 32, which can enhance the speed of taking and pushing the nails of the nail pushing piston. Moreover, the exhausting hole 33 or 34 has a cross section farther smaller than the cross section of the nail pushing passage 10, which can help to maintain the air pressure of the high pressure air in the nail pushing cylinder 30 and prevent the high pressure air from fast exhausting from the nail pushing cylinder 30.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A pneumatic nail gun, comprising:

a gun body including a nail punching piston and a nail pushing passage, the nail punching piston being induced by high pressure air to move downwardly to punch the nails and move upwardly to reposition;

a nail pusher disposed between an end of the nail pushing passage and a canister, the nail pusher comprising a nail pushing cylinder connecting to the nail pushing passage, the nail pushing cylinder comprising a nail pushing piston and a spring therein; and an air distribution ring fixing to an inner surface of the gun body and adjacent to the other end of the nail pushing passage, the air distribution ring comprising at least one axial through hole and at least one radial through hole, the at least one axial through hole guiding the high pressure air to drive the nail punching piston to reposition after the nail punching piston moves downwardly to punch the nails, the at least one radial through hole guiding and pushing the high pressure air into the nail pushing cylinder via the nail pushing passage to drive the nail pushing piston to take the nails after the nail punching piston move downwardly to punch the nails, and the at least one radial through hole also exhausting the high pressure air in the nail pushing cylinder and the nail pushing passage to make the nail pushing piston reposition to push the nails when the nail punching piston moves upwardly to reposition.

2. The pneumatic nail gun as claimed in claim 1, wherein the gun body comprises a main air chamber for containing the high pressure air, a moveable cylinder for containing the nail punching piston, and a slidable sleeve valve disposed at a peripheral of the moveable cylinder, the moveable cylinder being divided into a first air chamber and a second air chamber in the gun body, the slidable sleeve valve being divided into a third air chamber and a fourth air chamber in the gun body, the first, the second, the third, and the fourth air chambers being connected to the main air chamber, and the air distribution ring being fixed to an inner surface of the fourth air chamber.

3. The pneumatic nail gun as claimed in claim 2, wherein the nail punching piston divides the moveable cylinder into a top air chamber and a bottom air chamber to contain the high pressure air, the moveable cylinder comprises a plurality of intermediate vent holes, the slidable sleeve valve comprises at least one intermediate valve, and the radial through hole guides and pushes the high pressure air in the top air chamber into the nail pushing cylinder via the intermediate vent holes of the moveable cylinder and the slidable sleeve valve.

4. The pneumatic nail gun as claimed in claim 2, wherein the slidable sleeve valve comprises at least one check valve and at least one intermediate valve, a ring groove is formed between the slidable sleeve valve and the moveable cylinder, the ring groove is connected with the at least one check valve and the at least one intermediate valve, and the radial through hole guides and pushes the high pressure air in the top air chamber into the nail pushing cylinder via the vent holes of the at least one intermediate valve, the ring groove, and the check valve.

5. The pneumatic nail gun as claimed in claim 1, wherein the air distribution ring further comprises a plurality of air seals disposed at an inner and outer surfaces thereof.

6. The pneumatic nail gun as claimed in claim 1, wherein the nail pushing cylinder comprises an exhausting hole connecting with environment, the exhausting hole is disposed at an inner surface of the nail pushing cylinder, which has a cross section farther smaller than the cross section of the nail pushing passage.

7. The pneumatic nail gun as claimed in claim 1, wherein the nail pushing piston comprises an exhausting hole connecting with environment, the exhausting hole has a cross section farther smaller than the cross section of the nail pushing passage.

* * * * *